United States Patent [19]

LaVos et al.

[11] Patent Number: 5,050,853

[45] Date of Patent: Sep. 24, 1991

[54] DEVICE FOR DISCHARGING SHEETS FROM THE BOTTOM OF A STACK

[75] Inventors: Peter G. LaVos, MA Baarlo; Sietse Vlietstra, HH Venlo, both of Netherlands

[73] Assignee: Oce-Nederland B.V., Venlo, Netherlands

[21] Appl. No.: 499,945

[22] Filed: Mar. 27, 1990

[30] Foreign Application Priority Data

Mar. 28, 1989 [NL] Netherlands ..... 8900754

[51] Int. Cl.[5] ..... B65H 3/12

[52] U.S. Cl. ..... 271/98; 271/99; 271/104

[58] Field of Search ..... 271/90, 98, 99, 104, 271/105, 132

[56] References Cited

U.S. PATENT DOCUMENTS

| | | | |
|---|---|---|---|
| 2,812,178 | 11/1957 | Hagren | 271/29 |
| 3,099,442 | 4/1963 | Wendricks et al. | 271/32 |
| 3,782,716 | 1/1974 | Long et al. | 271/99 |
| 3,947,018 | 3/1976 | Stange | 271/99 |
| 4,014,537 | 3/1977 | Stange | 271/105 |
| 4,462,586 | 7/1984 | Browne et al. | 271/98 |
| 4,579,330 | 4/1986 | Lehmann | 271/98 |
| 4,616,815 | 10/1986 | Vijuk | 271/99 |
| 4,728,091 | 3/1988 | Couwenberg | 271/99 |
| 4,887,805 | 12/1989 | Herbert et al. | 271/98 |

FOREIGN PATENT DOCUMENTS

| | | | |
|---|---|---|---|
| 698520 | 11/1964 | Canada | 271/99 |
| 2240161 | 3/1973 | Fed. Rep. of Germany | 271/98 |
| 1460465 | 11/1966 | France . | |
| 7307016 | 9/1974 | France . | |
| 295216 | 7/1963 | Netherlands . | |
| 1412596 | 11/1975 | United Kingdom | 271/99 |

*Primary Examiner*—Robert P. Olszewski
*Assistant Examiner*—Steven Reiss
*Attorney, Agent, or Firm*—Reed, Smith, Shaw & McClay

[57] ABSTRACT

A pneumatic sheet separating device is provided whereby sheets in a holder can be discharged one by one from the bottom of a stack and wherein the holder is provided with a carrier and lateral supports. The carrier is permanently bent or depressed transversely of the direction of sheet transport such that it is nonplanar. In the vicinity of the deepest part of the bend or depression, the carrier is preferably provided with at least one aperture beneath at least one edge zone of a side edge of the stack of sheets in the holder, wherein a partial vacuum can be created so that the bottom sheet is sucked against the carrier. An air duct is also provided to blow air against the side edge of the stack, as considered with respect to the direction of sheet transport, to create a layer of air at least between the bottom sheet and the stack thereabove. Preferably the air duct is disposed so that the air flow is blown out over the deepest part of the carrier causing the friction between the bottom sheet which is to be discharged and the stack thereabove to be reduced. At the instant that the layer of air forms between the bottom sheet and the stack thereabove, the bottom sheet is discharged by a transport belt.

8 Claims, 3 Drawing Sheets

DEVICE FOR DISCHARGING SHEETS FROM THE BOTTOM OF A STACK

FIELD OF THE INVENTION

The present invention relates to a pneumatic device for separating and discharging sheets one by one from the bottom of a stack of sheets.

BACKGROUND OF THE INVENTION

A pneumatic sheet feeder is described in U.S. Pat. No. 4,579,330 wherein the upper surface of the carrier is flat and two parallel lateral abutments are provided thereon which have a number of blowing apertures on the facing sides. By blowing air through these apertures towards the sides of the stack of sheets, thin air layers are formed between the bottom sheets of the stack thereby separating them. The bottom-most sheet is then drawn towards a rotatable suction roll provided with holes in which a partial vacuum is created. The bottom-most sheet is discharged from the stack by means of the suction roll.

Considerable leakage occurs in this device when air is supplied to the stack. Primarily the leakage occurs at the front and rear of the stack of sheets, when considered in the direction of sheet transport, and results in a considerable amount of air being required by the device to separate the bottom sheet from the rest of the stack. This, of course, necessitates the use of large fans with their accompanying considerable amount of noise. Moreover, if there are only a small number of sheets in the stack to be discharged, the sheets in the holder will vibrate causing an adverse effect on the sheet separation process and further increasing the noise.

To prevent more than one sheet from being discharged simultaneously in this device, a retaining plate must be used which has to be adjusted to the exact thickness of the sheets in the stack so that only one sheet can pass under the retaining plate and over the rotatable suction roll. In practice it has been found that even a slight deformation of the side edge of the sheet situated directly above the bottom sheet in such a device prevents said sheet from being separated from the bottom sheet. It has also been found that unless air is blown over the entire length of the side edges of the sheets in the stack, the stack bends and deforms in an undesirable way when air is supplied, making separation more difficult. Furthermore, the resistance of the stack to deformation in such cases counteracts the force exerted by the supplied air, so that not only the weight but also the bending resistance of the stack of sheets exerts an influence on the air layer that has formed with the result that the nature of the stack greatly influences the reliability of separation. U.S. Pat. No. 2,812,178 and Dutch Patent Application 295,216 disclose sheet separating devices similar to that described in U.S. Pat. No. 4,579,330.

French Patent No. 1,460,465 discloses a sheet feeder where sheets are drawn from the bottom of a stack without the use of blown air. The sheets are separated by transporting the bottom sheet, using a belt with a suction box inside the circumference of the belt while the other sheets in the stack, which lie directly on top of the bottom sheet, are prevented from being transported simultaneously with the bottom sheet using a preset retaining plate.

U.S. Pat. No. 3,099,442 and French Patent 2.219.665 disclose other devices for separating sheets using blown air. In the device described in U.S. Pat. No. 3,099,442 air is used to draw the bottommost sheet towards the carrier and the stack is lifted using air blown to the side of the flat lying stack. Separation is more difficult owing to the fact that air is not blown over the entire length of the side edges of the stack. This sheet feeder therefore has the drawbacks already stated above for U.S. Pat. No. 4,579,330. The device described in French Patent 2.219.665 uses blown air to discharge a sheet from the top of a stack, not the bottom of a stack.

It would be desirable, therefore, to have a pneumatic sheet separating and discharge device which did not have the above-described disadvantages.

SUMMARY OF THE INVENTION

The present invention provides a device for separating and discharging sheets one by one from the bottom of a stack of sheets comprising: a holder for a stack of sheets provided with a carrier and a plurality of lateral supports; pneumatic means being provided for blowing air against the side edge of the stack, as considered with respect to the direction of transport of the sheets, to create a layer of air at least between the bottom sheet and the stack thereabove; and a transport means to discharge the bottom sheet. The carrier is formed with a transversely extending depression or downwardly curved portion such that it is nonplanar and is provided with at least one aperture beneath at least one edge portion of a side edge of the stack of sheets in the holder wherein a partial vacuum can be created in the aperture using suitable vacuum means. The pneumatic means for blowing air against the stack side edge is so disposed that the air flow is blown out over the downwardly curved portion of the carrier, preferably where the deepest part of the depression or downwardly curved portion is located. Preferably, the depression or downwardly curved portion extends the entire length across the surface of the carrier transverse of the direction of sheet transport.

Since air is blown towards the side edge of the stack of sheets, preferably in the vicinity of the deepest part of the downwardly curved portion of the carrier while the bottom sheet is simultaneously sucked against the upper surface of the carrier, an air layer or pocket forms between the bottom sheet and the stack thereabove such that the stack is lifted away from the bottom sheet thereby reducing the friction between the bottom sheet and the rest of the stack. As a result, the bottom sheet can easily be separated and transported away from the stack without disturbing it or causing a plurality of sheets to be simultaneously transported. Since only the bottom sheet sags or deforms to fit the downwardly curved upper surface of the carrier, the stack remains substantially rigid without deformation. The bending resistance of the stack has practically no effect on the air layer and good separation of the bottom sheet from the stack thereabove can be obtained even with different stack weights, different stack heights and different sheet stiffnesses, within wide limits, and without any adjustment in the amount of air blown into the carrier.

Preferably, the carrier has at least two apertures in the upper surface in the vicinity of the deepest portion thereof, one each beneath the edge zone of the two side edges of the stack of sheets. A partial vacuum is created in the apertures to suck the bottom sheet against the upper surface of the carrier. Preferably, the pneumatic means for blowing air against the stack side edges comprises two air ducts and two apertures which are disposed such that the air flow is blown over the deepest portion of the downwardly curved carrier and against the two side edges of the stack. As a result, the forces exerted on the sheets during the air blowing are distributed more uniformly over the stack thereby improving the device's reliability. Preferably the aperture in the carrier is located near the aperture in the lateral support where the air is effectively blown into the stack by the pneumatic means. In one embodiment the aperture in the carrier consists of a plurality of openings which extend near the zone where air is blown effectively into the stack. To improve separation of the bottom sheet from the stack thereabove, the portion of the carrier, preferably between the front edge and the middle, as considered in the direction of transport of the sheets, is depressed, downwardly curved or sagged permanently. By blowing air into the vicinity of the deepest part of this downwardly curved portion of the carrier, an air layer forms at the front between the bottom sheet and the stack thereabove so that the contact between the front edge of the bottom sheet and the front edge of the stack is reduced. This reduces the friction between the sheets and facilitates the separation of the bottom sheet from the stack.

In one embodiment, the carrier is sagged or deflected in a curved shape transversely of the direction of sheet transport. In another embodiment this deflection or deformation is such that the front part of the carrier forms an obtuse angle with the rear part. This angle is preferably between 150° and 175°. When the bottom sheet is sucked against the carrier, this sheet will follow and conform to the shape of the carrier better than the stack thereabove so that an opening forms between the bottom sheet and the stack at the downwardly curved area. By blowing air into the side edges of the stack in the vicinity of the deepest portion of the concave shape, the air layer will form mainly in this area between the bottom sheet and the stack thereabove.

Devices are known wherein air is blown into the stack of sheets at the front thereof as considered in the direction of sheet transport. By comparison with these devices, the device according to the present invention has the advantage that simple displacement of one or both lateral supports, within certain preset limits, makes it suitable for the use of many different formats. Furthermore, when the device according to the present invention is used in an electrophotographic copying machine to discharge a set of documents repeatedly sheet by sheet to the exposure window of the copying machine, whereafter the sheets are copied and then re-deposited in the holder, this device also has the advantage that the sheets are not deposited in opposition to the air flow, so that the sheets come to rest on the stack very rapidly and are well positioned.

Other details, objects and advantages of the present invention will become apparent as the following description of the presently preferred embodiment of practicing the invention proceeds.

BRIEF DESCRIPTION OF THE DRAWINGS

In the accompanying drawings, preferred embodiments of the present invention are illustrated wherein.

DETAILED DESCRIPTION OF THE INVENTION

Figure 1:
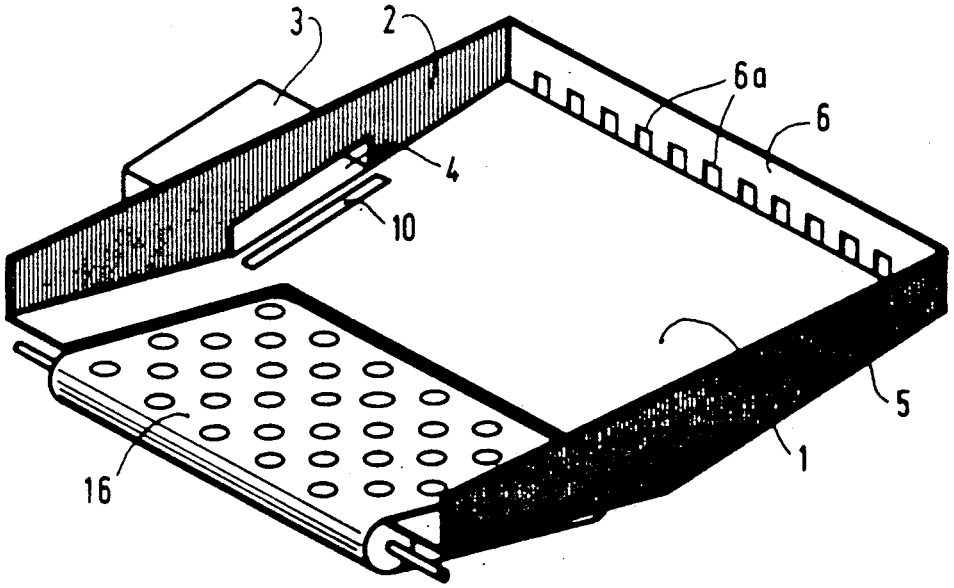
FIG. 1 is a perspective view of one embodiment of the present invention.

The sheet discharging device as shown in FIG. 1 uses a holder for a stack of sheets having a downwardly curved carrier 1 such that the carrier 1 is nonplanar i.e., it has a depressed portion and does not all lie in one plane. The holder also has as a lateral support, a side wall 2 to which there is secured an air supply duct 3 which is adapted to be connected to an air supply source (not shown) and which terminates in an aperture 4 in the vicinity of the deepest part of the holder, through which air is blown perpendicularly to the direction of sheet transport and parallel to the carrier towards one side edge of the stack. The holder is also provided with a second side wall 5 and a back wall 6 formed with apertures 6*a*.

In the vicinity of the blowing aperture 4, the carrier 1 has a second aperture 10 in its upper surface via which the bottom sheet in the stack is sucked towards the carrier 1 near aperture 4. Aperture 10 is formed as a slot which extends near the area where air is effectively blown into the stack through aperture 4 and is situated near a side edge of the bottom sheet to prevent the air blown into the stack from being blown between the bottom sheet and the carrier 1.

Figure 2:
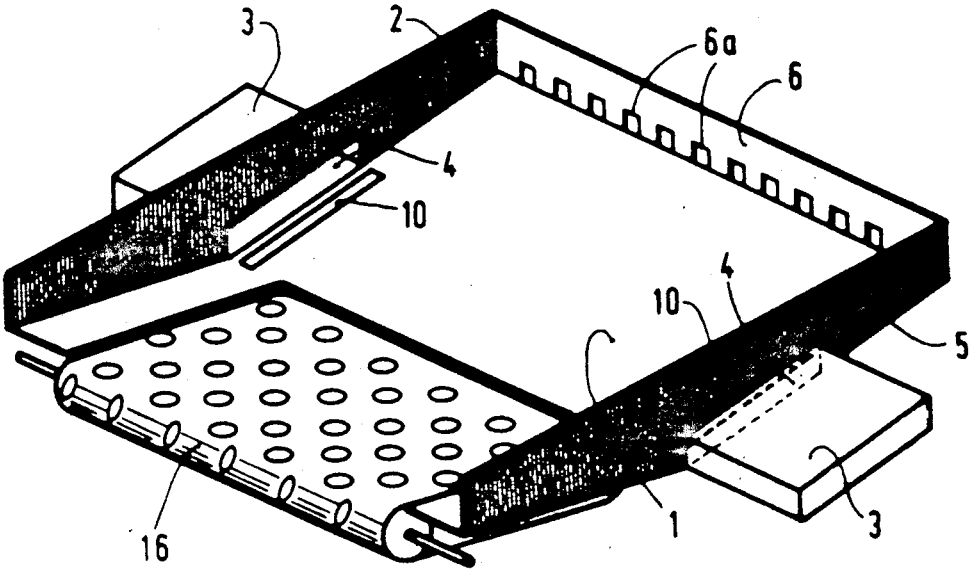
FIG. 2 is a perspective view of another embodiment of the present invention.

In the embodiment shown in FIG. 2, both side walls 2 and 5 of the holder are provided, in the vicinity of the deepest part of the carrier 1, with an air supply duct 3 adapted to be connected to the air supply source (not shown). Near the deepest part of the carrier 1, the two side walls 2 and 5 are provided with a blowing aperture 4 to which each air supply duct 3 is connected. Near the two blowing apertures 4 the carrier 1 has suction apertures 10 in the upper surface thereof.

Figure 3:
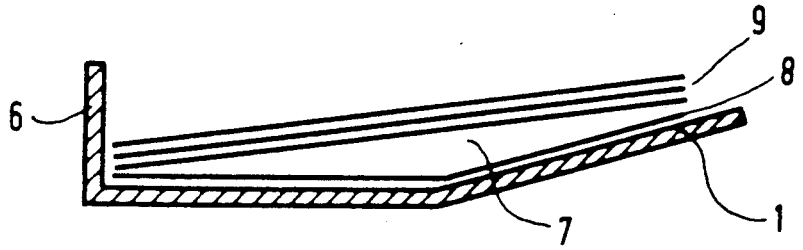
FIG. 3 is a diagrammatic side elevation showing the lifting of the stack in a downwardly curved carrier of the present invention.
Figure 4A:
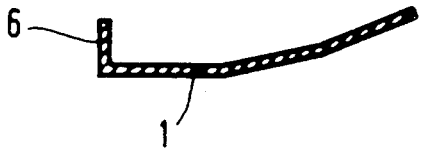
FIGS. 4*a*–4*d* are diagrammatic side elevations showing different embodiments of the downwardly curved carrier of the present invention.
Figure 4B:
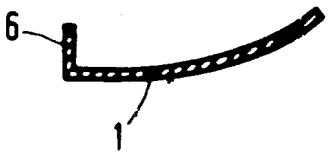
Figure 4C:
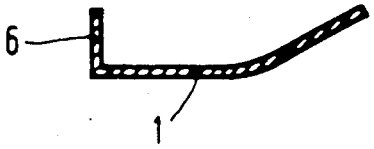
Figure 4D:
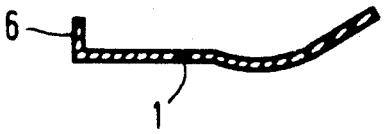

As shown in FIG. 3, the blowing of air into the stack of sheets causes a layer of air 7 to form between the rest of the stack 9 and the bottom sheet 8 which is sucked against the carrier 1 as a result of the partial vacuum in aperture 10. The partial vacuum is created using vacuum means (not shown) well know in the art. As shown in FIGS. 4*a*–4*d*, the carrier of the present invention can be transversely sagged, deflected, or depressed in a variety of nonplanar and downwardly curved shapes. It will be clear to one skilled in the art that many other transversely extending downwardly curved shapes of carriers can be used in practicing the present invention and that the present invention is not limited to the embodiments shown in these Figures.

Figure 5:
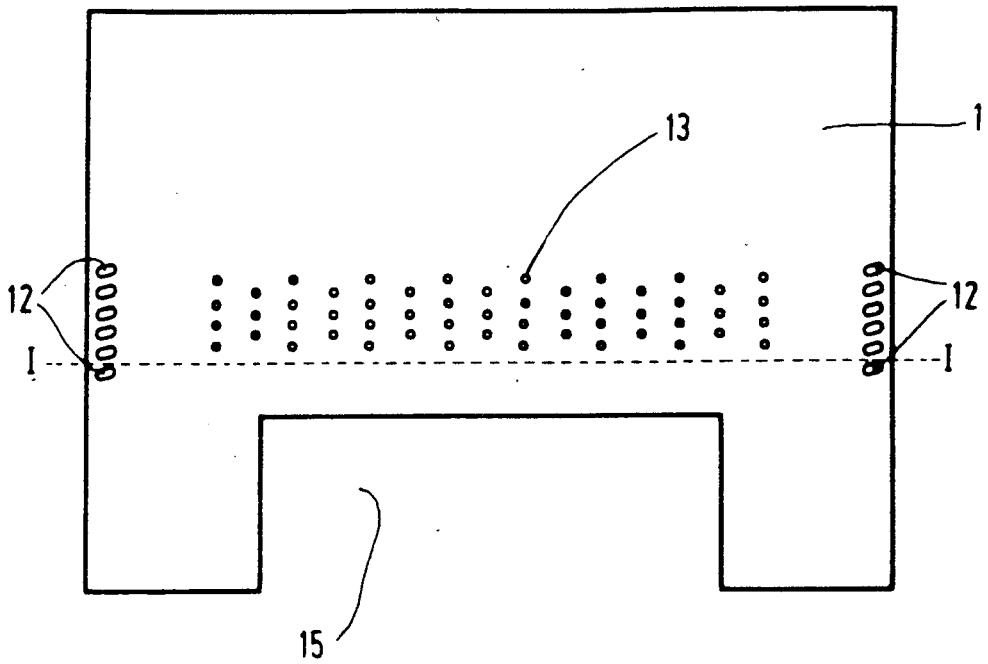
FIG. 5 is a diagrammatic top plan view of another embodiment of the downwardly curved carrier.

The carrier 1 shown in FIG. 5 is bent at the place indicated by the line I—I such that the angle between the front part of the carrier and the rear part of the carrier is 168°. Near the vertex of the angle, the carrier is provided with a plurality of suction apertures 12 near the side walls, which have the same function as the suction apertures 10 in the embodiments shown in FIGS. 1 and 2. Additionally, the carrier 1 has a plurality of apertures 13 in the vicinity of the middle of the carrier as considered in the direction of transport of the sheets, in which apertures a partial vacuum can be created again, by using vacuum means well known in the art. The carrier 1 is also provided with a recess 15 for receiving a transport means 16 which is used to discharge the bottom sheet from the stack.

Figure 6A:
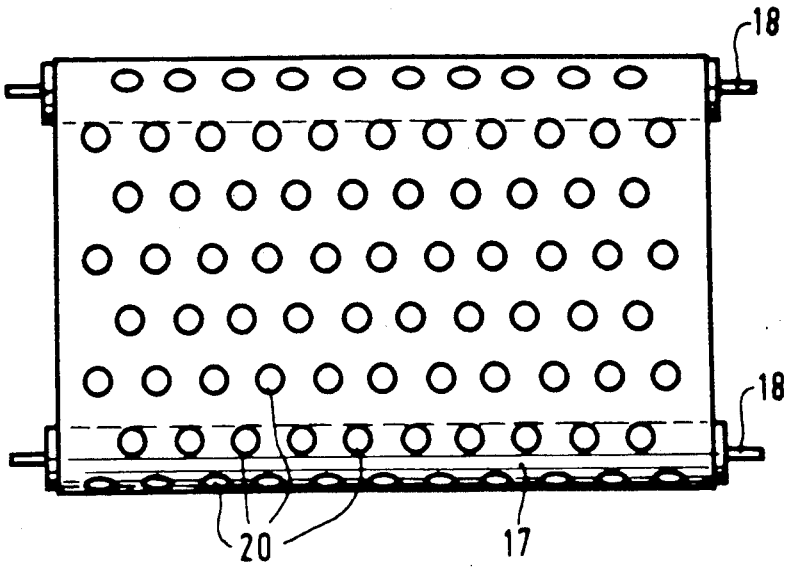
FIG. 6*a* is a diagrammatic top plan view and FIG. 6*b* is a side elevation view of a transport means having a movable endless belt used in the present invention.
Figure 6B:
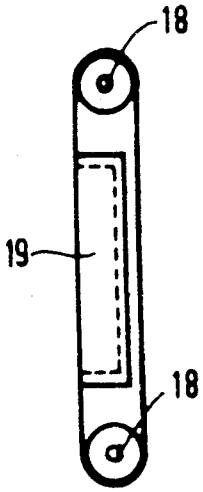

The transport means 16 of FIGS. 1 and 2 is shown in detail in FIGS. 6*a* and 6*b* and comprises a movable endless rubberized belt 17 formed with a plurality of apertures 20 in which a partial vacuum can be created. The rubberized belt 17 moves about two rollers 18 and over a suction box 19 situated within the periphery of the belt 17. Suction box 19 is connected to a vacuum device (not shown) whereby a partial vacuum can be created in the apertures 20. This transport means 16 is preferred because of its larger effective suction area.

To enable the bottom sheet to be discharged, the belt 17 must exert a sufficient force on the bottom sheet such that both the friction between the bottom sheet and the carrier 1 and the friction between the bottom sheet and the sheet situated directly thereabove is overcome. The force exerted by the belt 17 on the bottom sheet depends on several factors including the coefficient of friction between the belt 17 and the bottom sheet which is to be transported, the partial vacuum in the suction box 19 and the effective suction area. The effective suction area is the operative surface where the partial vacuum is located and depends on several factors including the roughness of the belt 17, the roughness of the sheet to be transported, the size of the apertures 20, the pattern of the holes in the belt 17, and the size of the suction box 19 beneath the belt 17. It may be advantageous to make the apertures 20 in the belt 17 wider at the side facing the sheets than on the opposite side so that the effective suction area is increased while retaining the firmness of the belt 17. Other transport means known for this purpose can be used in the present invention instead of the belt 17 including a friction roll or a suction roll as described in U.S. Pat. No. 4,579,330.

The lateral supports of the holder need not necessarily consist of side walls extending along the entire side edge of the stack as shown in FIGS. 1 and 2 but instead may be formed as lateral abutments against part of the stack or as locating pins. Preferably one or more air supply ducts is disposed near the lowest portion of the downwardly curved carrier surface and feed into blowing apertures directed towards the side of the stack. It is not necessary for the lateral supports to directly adjoin the stack.

In an electrophotographic copying machine, the device of the present invention can be used to discharge a set of documents repeatedly sheet by sheet to the exposure window of the machine, whereafter the sheets are copied and then re-deposited in the holder. To promote good positioning of the sheets to be deposited on the stack and good separation, it is desirable for the holder to be so situated, as considered in the direction of transport, that the front edge of the carrier 1 is higher than the rear edge. Moreover, by making one or two lateral supports movable, it is possible within certain limits to use the device for discharging sheets of different formats. The rear wall can also be made movable for this purpose.

Preferably, the device described above operates as follows. By creating a partial vacuum in the various apertures in the carrier 1 and the transport belt 17 and by blowing air against the side edge of the stack in the vicinity of the deepest part of the downwardly curved carrier 1 the bottom sheet 8 is sucked against the carrier and a layer of air 7 or an air chamber forms between the bottom sheet 8 and the stack 9 thereabove because the front and rear sides of the stack operate as a seal because of the dead weight of the stack. The pressure exerted by the air in the layer of air 7 causes the stack 9 situated above the bottom sheet 8 to be lifted therefrom so that the friction between the bottom sheet 8 and the rest of the stack 9 is reduced. The size and shape of the space between the bottom sheet 8 and the rest of the stack 9 is influenced by a variety of factors including the shape of the carrier, the place where the air is blown in, the number of blowing apertures 4 in the side walls 2 and 5, the shape of the blowing apertures 4, the direction in which the air is blown, the amount of air blown into the stack, the air velocity, and the presence of leakage apertures through which air can escape from the stack. Depending upon the construction of the device, one skilled in the art can easily arrive at the appropriate combination of air velocity, amount of air blown in and blowing direction to achieve good separation for different types of paper and other materials in the stack.

At the instant that the layer of air 7 forms between the bottom sheet 8 and the stack 9 thereabove, the bottom sheet can easily be separated and is discharged by the transport means 16. In these conditions, it is particularly advantageous to pull the bottom sheet away beneath the stack at high acceleration. The sheet situated directly above the bottom sheet then remains behind due to inertia. Good results can be obtained using an acceleration for the bottom sheet of about 30 $m/s^2$.

If the carrier 1 is formed with apertures 13 (as shown in FIG. 5) near the middle of the carrier as considered in the direction of transport of the sheets wherein a partial vacuum can be created, then after the bottom sheet 8 has been pulled away from the apertures 13, the air present between the sheet and the stack thereabove can be discharged so that the sheet situated directly above the bottom sheet is conveyed rapidly to the carrier, whereafter said sheet is sucked against the carrier at the apertures in which there is a partial vacuum. After the bottom sheet has been discharged from the holder the drive for the transport means 16 is stopped because some time is required before a new layer of air forms between the next sheet which has been sucked against the carrier and is now the bottom sheet, and the stack, thereby enabling the new bottom sheet to be transported. This time depends on a variety of factors including the amount of air blown in, the air velocity and the stiffness of the sheets. It should be noted that during the discharge of the sheets one by one the partial vacuum in the various apertures of the carrier 1, the partial vacuum in the suction box 19 situated within the periphery of the transport belt 17, and the air supply to the stack can be maintained.

While a presently preferred embodiment of practicing the invention has been shown and described with particularity in connection with the accompanying drawings, the invention may be otherwise embodied within the scope of the following claims.

What is claimed is:

1. A device for discharging sheets one by one from the bottom of a stack of sheets comprising: a holder for a stack of sheets provided with a carrier and a plurality of lateral supports; a pneumatic means being provided for blowing air against the side edge of the stack, as considered with respect to the direction of transport of the sheets, to create a layer of air at least between the bottom sheet and the stack thereabove; and a transport means to discharge the bottom sheet, wherein the carrier has a transversely extending downwardly depressed portion such that it is nonplanar and is provided with at least one aperture beneath at least one edge portion of a side edge of the stack of sheets in the holder wherein a partial vacuum can be created in the aperture by a vacuum means, the downward depressed portion of the carrier comprising a depression in an upper surface of the carrier extending levelly, entirely along its length in the direction transversely to the direction of sheet transport, and the pneumatic means for blowing air against the stack side edge is so disposed that the air flow is blown out over the depressed portion of the carrier.

2. A device as described in claim 1 wherein the depression in the upper surface of the carrier as considered in the direction of transport forms an obtuse angle.

3. A device as described in claim 2 wherein the obtuse angle is between 150° and 175°.

4. A device as described in claim 1 wherein the carrier near both side edges has at least one aperture which extends near the zone where air is blown against the stack side edge by the pneumatic means and in which a partial vacuum can be created, and wherein the pneumatic means for blowing air against the stack side edge comprises two ducts and two apertures disposed such that the air flow is blow over the deepest portion of the downwardly depressed surface of the carrier and against both side edges of the stack of sheets.

5. A device as described in claim 1 wherein the aperture extends near the zone where air is blown against the stack side edge by the pneumatic means.

6. A device as described in claim 1 wherein the aperture in the carrier consists of a plurality of openings which extend near the zone where air is blown effectively into the stack.

7. A device as described in claim 1 wherein the downwardly depressed portion of the carrier is located between the front edge of the carrier and the middle thereof as considered in the direction of sheet transport.

8. A device as described in claim 1 wherein the carrier further comprises a plurality of apertures located in the deepest part of the downwardly depressed portion of the carrier wherein a partial vacuum can be created.

* * * * *